United States Patent [19]

Udoh

[11] 4,304,396

[45] Dec. 8, 1981

[54] COOLING BOX FOR STEEL-MAKING ARC FURNACE

[75] Inventor: Eiji Udoh, Nishinomiya, Japan

[73] Assignee: Nikko Industry Co., Ltd., Hyogo, Japan

[21] Appl. No.: 76,559

[22] Filed: Sep. 18, 1979

[51] Int. Cl.[3] ..... F27D 1/12

[52] U.S. Cl. ..... 266/193; 13/32; 122/6 A; 266/241

[58] Field of Search ..... 266/193, 241; 122/6 B, 122/6 R, 6 A; 165/170; 13/32

[56] References Cited

U.S. PATENT DOCUMENTS

| | | | |
|---|---|---|---|
| 378,550 | 2/1888 | Kennedy | 122/6 B |
| 515,694 | 2/1894 | Rotthoff | 122/6 B |
| 2,988,336 | 6/1961 | Woolard | 165/170 |
| 3,241,528 | 3/1966 | Loecher | 266/193 |
| 3,628,509 | 12/1971 | Becker et al. | 266/193 |

FOREIGN PATENT DOCUMENTS

| | | | |
|---|---|---|---|
| 50-137307 | 11/1975 | Japan | 13/32 |
| 51-133306 | 10/1976 | Japan | 13/32 |
| 52-104908 | 8/1977 | Japan | 13/32 |
| 52-135404 | 10/1977 | Japan | 13/32 |
| 54-35706 | 3/1979 | Japan | 13/32 |

*Primary Examiner*—M. J. Andrews

*Attorney, Agent, or Firm*—Koda and Androlia

[57] ABSTRACT

A cooling box adapted to be installed in the refractory wall of a steel-making arc furnace for passing a cooling medium therethrough to cool the wall. The box comprises a base plate having an inlet and an outlet for the medium, a heat receiving copper plate having a slag lodging portion over the heat receiving surface thereof and a curved portion at each of its upper and lower ends for preventing cracking against thermal and mechanical stress concentration, and a back plate disposed between the plates closer to the heat receiving plate. The back plate and the heat receiving plate define a cooling medium flow chamber in communication with the inlet and the outlet and divided by a plurality of partitions to provide a flow channel of reduced cross section over the entire area of the heat receiving plate.

3 Claims, 7 Drawing Figures

COOLING BOX FOR STEEL-MAKING ARC FURNACE

BACKGROUND OF THE INVENTION

The present invention relates to a cooling box adapted to be installed in the refractory wall of a steel-making arc furnace for cooling the furnace wall.

In recent years, high power is supplied to steel-making arc furnaces to shorten the melting time and achieve improved efficiency. For example, arc furnaces of the standard type are equipped with a transformer for giving 300 kva/ton, while super-large furnaces are provided with a transformer with a capacity of 600 kva/-ton.

Accordingly the heat of arc locally causes serious damage to the lining wall of the furnace at a so-called hot spot where the wall is opposed to the electrode. The furnace wall is also subject to marked damage or erosion in the vicinity of the slag line. Cooling boxes are therefore installed in the refractory wall of the furnace at such locations.

While cooling boxes of steel are generally used for this purpose, the steel box involves the problem that cracks are liable to develop therein owing to thermal and mechanical stress concentration when it is installed in the hot spot or in the neighborhood of the slag line. Such cracks will permit leakage of the cooling medium, possibly leading to an explosion accident, so that the cooling box must be repaired with a great expenditure and much labor.

SUMMARY OF THE INVENTION

An object of the present invention is to overcome the above problem and to provide a cooling box which is adapted to be installed in the refractory wall of an arc furnace for cooling the wall with a cooling medium and which comprises a heat receiving plate made of copper and capable of withstanding high thermal load.

Another object of the invention is to provide a cooling box which comprises a heat receiving plate having a slag lodging portion over the heat receiving surface thereof and curved portions where the plate is subject to thermal and mechanical stress concentration so as to avoid cracking.

Still another object of the invention is to provide a cooling box which comprises a base plate and a heat receiving copper plate welded together into a square to rectangular box to form an interior channel for passing a cooling medium therethrough, the channel having a reduced cross section and extending over the entire area of the heat receiving plate to permit the cooling medium to flow therethrough at an increased rate and to assure uniform cooling over the entire area.

To fulfil the foregoing objects, the present invention provides a cooling box adapted to be installed in the refractory wall of a steel-making arc furnace for cooling the wall with a cooling medium. The cooling box comprises a base plate having an inlet and an outlet for the cooling medium and a heat receiving copper plate having a slag lodging portion over the heat receiving surface thereof and a curved portion at each of its upper and lower ends. The plates are welded together into a square to rectangular box. In the interior of the box defined by the base plate and the heat receiving plate, a back plate is positioned closer to the heat receiving plate and welded to the box. The back plate and the heat receiving plate define a cooling medium flow chamber which is in communication with the inlet and the outlet and which is divided by a plurality of partitions.

Other objects, features and advantages of the invention will become apparent from the following detailed description of an embodiment with reference to the accompanying drawings.

DETAILED DESCRIPTION OF THE INVENTION

Figure 1:
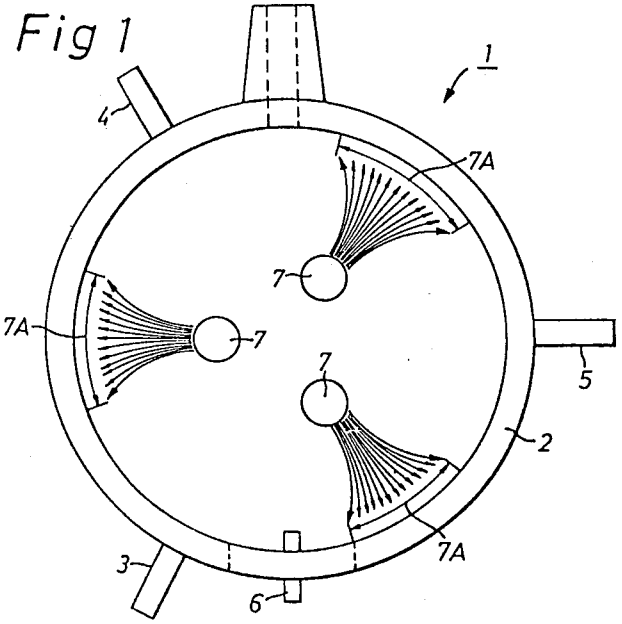
FIG. 1 is a plan view schematically showing a steel-making arc furnace.
Figure 3:
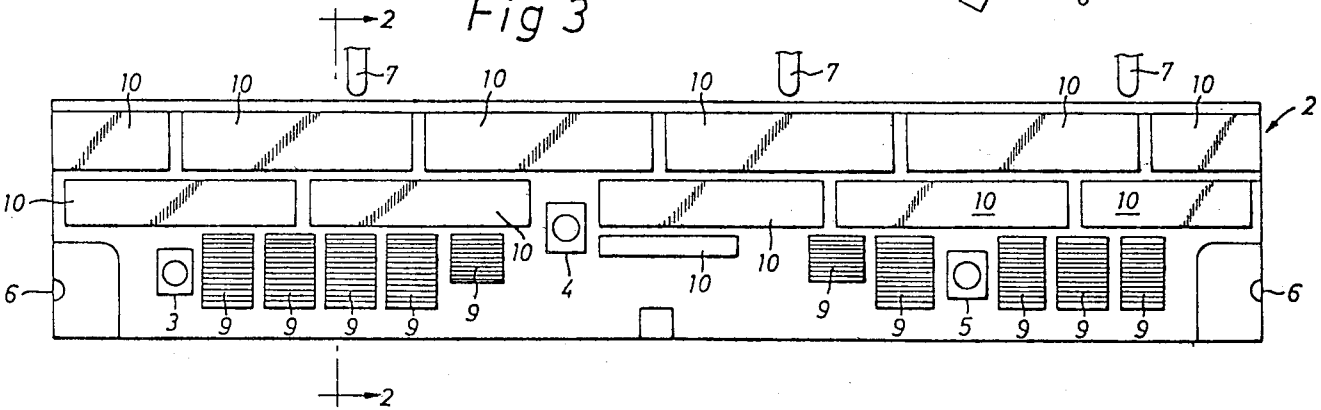
FIG. 3 is a diagram in development showing the furnace wall.

With reference to FIGS. 1 and 3, a steel-making arc furnace 1 comprises a refractory wall 2 made of refractory brick or some other refractory material and provided with burners 3, 4, 5 and 6 arranged at suitable locations along the circumference of the wall 2. Three electrodes 7 are disposed in the center of the furnace 1.

The heat of arcs produces hot spots 7A on the furnace wall 2 where the wall opposes the electrodes 7. The wall is subject to marked damage at these portions, and marked damage or cracking is also liable to take place in the vicinity of a slag line 8 (FIG. 2).

With reference to FIG. 3 showing the furnace wall 2 in development, cooling boxes 9 having a heat receiving copper plate are individually arranged at the hot spots 7A of the wall 2 and also in the vicinity of the slag line 8 according to this invention. The other portion of the wall is provided with cooling boxes 10 wholly made of steel and individually arranged in a plurality of stages. A cooling medium, such as water, can be passed through the boxes 9 and 10.

With reference to FIGS. 4 to 7, the cooling box 9 of this invention has the following construction.

Figure 2:
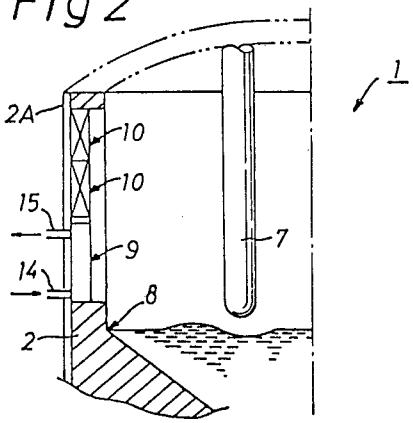
FIG. 2 is a diagram in section taken along the line 2—2 in FIG. 3 and showing part of the wall of the furnace.

A rectangular steel or copper base plate 11 is formed with a central aperture 12 and has seats 13 at its four corner portions for attaching the box 9 to the iron shell 2A shown in FIG. 2. Each of the seats 13 has a tapped bore 13A and a slanting bearing face 13B. The base plate can be detachably fastened to the inner side of the shell 2A with use of the tapped bores 13A.

Pipes are welded to upper and lower portions of the base plate 11 to provide an inlet 14 and an outlet 15 for the cooling medium. In the illustrated embodiment, the inlet and outlet are provided with covers 14A and 15A.

A heat receiving plate 16 is formed in its heat receiving surface with parallel furrows 17 arranged in the direction of the height of the furnace at predetermined spacing to provide a slag lodging portion 18. The slag lodging portion 18 is curved as at 19 at its upper and lower ends, and the curved portions 19 are integral with flanges 20. The plate 16 is therefore U-shaped in vertical section, is made of a deoxidized rolled copper plate and is opposed to the base plate 11 over the entire area thereof. The heat receiving plate 16 is welded to the base plate 11 along the edges of the upper and lower flanges 20 and also to a pair of steel or copper side plates 21 to form a rectangular box.

A steel or copper back plate 22 is disposed between the base plate 11 and the heat receiving plate 16 and positioned closer to the plate 16. The back plate 22 is welded to the inner edges of the side plates 21 and to the front edges of a pair of upper and lower plates 23. Thus the back plate 22 and the heat receiving plate 16 define a cooling medium flow chamber 25 communicating with the inlet 14 and the outlet 15 via portions 24.

Figures 4, 5, 6:
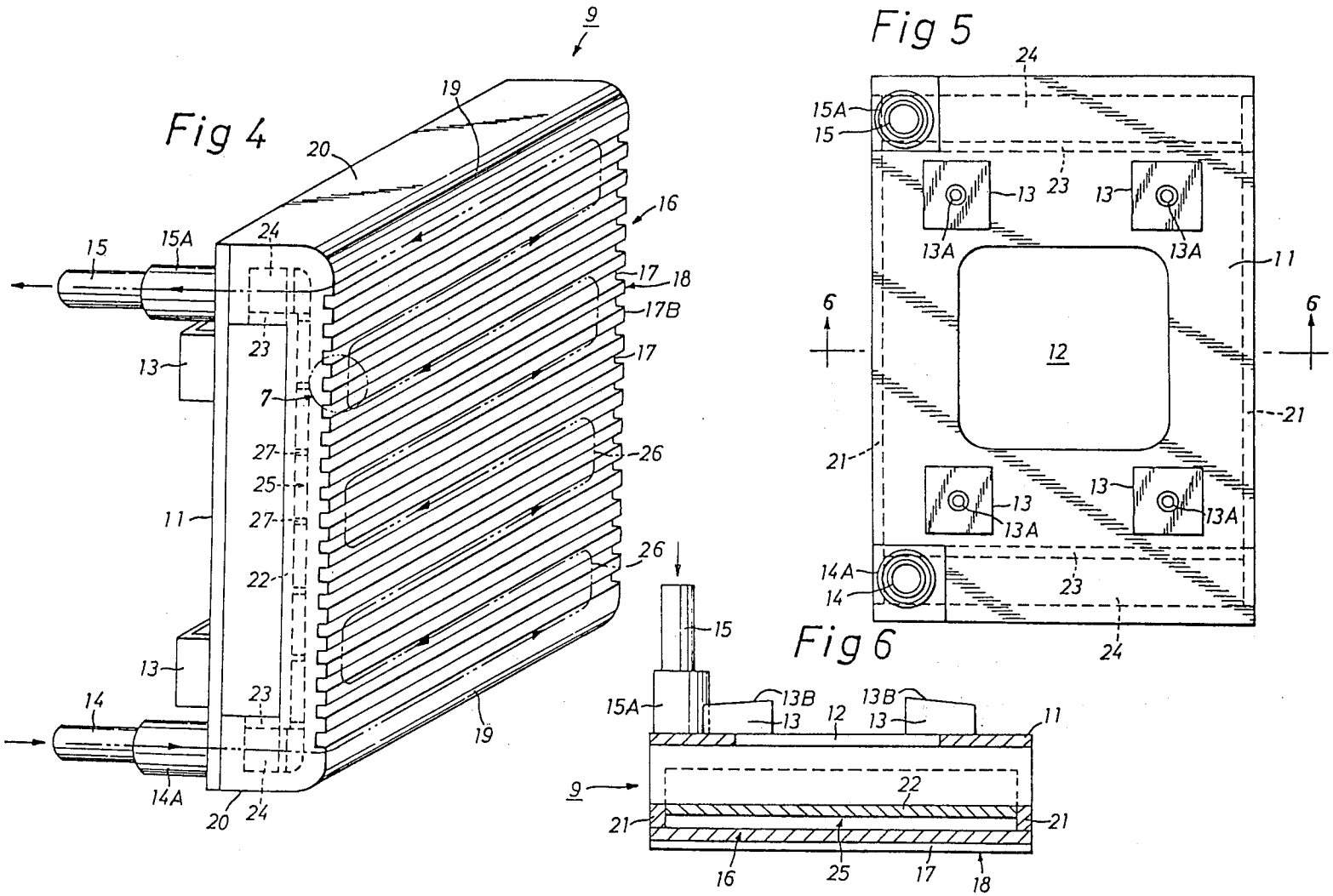
FIG. 4 is a perspective view showing a cooling box embodying the invention.
FIG. 5 is a rear view showing the box.
FIG. 6 is a view in section taken along the line 6—6 in FIG. 5.

The flow chamber 25 is divided into sections to provide a zigzag flow channel 26 as seen in FIG. 4. For this purpose, slender steel partitions 27 are welded to the back plate 22 and to the heat receiving copper plate 16 as provided therebetween and arranged in parallel in the direction of the height of the furnace at specified spacing. The channel 26 is narrow and flat as seen in FIG. 4.

Figure 7:
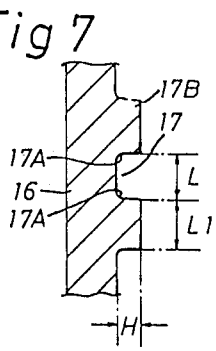
FIG. 7 is an enlarged view showing the portion of FIG. 4 indicated by an arrow 7.

FIG. 7 shows part of the slag lodging portion 18 in greater detail. The furrow 17 has a depth H which is about one half the width L thereof. The furrow 17 has curved corners 17A. The furrows 17 provide projections 17B having a width L1 slightly larger than the width L of the furrows 17. Alternatively projections 17B may be formed on the heat receiving surface as projected therefrom to provide the slag lodging portion 18.

The heat receiving copper plate 16 is approximately twice as thick as the base plate 11, side plates 21, upper and lower plates 23 and back plate 22. The curved portions 19 formed at the ends of the plate 16 have a radius of curvature larger than the thickness of the plate 16. When the plate 16 has a thickness of 30 mm, the radius of curvature is preferably 50 mm so as to provide a sufficiently large curved portion.

The partitions 27 are arranged at a larger pitch than the furrows 17 forming the slag lodging portion 18. With the present embodiment, the pitch of the partitions 27 is more than twice the pitch of the furrows 17.

The welded portion between the base plate 11 and the heat receiving plate 16, namely between steel or copper and copper, is formed by low-temperature welding with use of a filler rod of the copper-nickel type, whereby the welded portion is allowed to have sufficient strength while retaining the properties of copper. The filler rod of this type is compatible with both copper and steel, forms a good solid solution and does not give a brittle alloy. In fact, since nickel forms a solid solution with copper or steel, copper and steel can be welded under the same conditions to provide a welded joint, which is usable at high temperatures while fully withstanding the stress and strain due to thermal impact. Thus the filler rod of the copper-nickel type is used for low-temperature welding.

A further description will be given of the operation of the cooling box and also the operation of an arc furnace provided with such cooling boxes in its wall. Cooling boxes 9 are installed in the refractory wall 2 at the hot spots and near the slag line 8 in the arrangement of FIG. 3. Each cooling box 9 is detachably mounted on the iron shell 2A with the slag lodging portion 18 facing the interior of the furnace, by fitting the seats 13 on the base plate 11 to the shell 2A and screwing unillustrated bolts into the seats 13. Cooling boxes 10 made of steel are detachably installed in the other portion of the furnace wall 2. A cooling medium, such as water, is introduced to the flow chambers of the boxes 9 and 10 individually.

With the box 9 of this invention, the cooling medium fed to the inlet 14 flows through the zigzag flow channel 26 uniformly over the entire area of the heat receiving plate and is run off through the outlet 15. Since the flow channel 26 is positioned close to the copper plate 16 with the steel or copper back plate 22 located closer to the plate 16, and since the flow channel 26 is designed to have a reduced cross section with use of the partitions 27, the cooling medium flows at an increased rate to achieve an enhanced cooling effect, permitting the copper plate 16 to fully withstand high thermal load.

The heat receiving plate 16, which is a deoxidized rolled copper plate, is not prone to cracking at the corner portions of the box even when subjected to thermal and mechanical stress concentration, because the corner portions are in the form of curved portions 19 having a large radius of curvature. The base plate 11 for installing the box in the furnace wall 2 will impart sufficient strength to the box when made from steel.

Additionally the slag will lodge in the furrows 17 of the portion 18 on the plate 16 with ease. The slag, which is an electrical and thermal insulator, will protect the cooling box 9 against sparking that would cause damage to the box. With its very low heat conductivity, the slag further protects the box from the flame produced when oxygen or oil is introduced into the furnace during melting and refining, while holding the heat receiving surface out of direct contact with the molten metal to inhibit oxidation and abrasion. The slag also serves to absorb the impact attendant on charging. Thus the box is operable free of any leak of the cooling medium.

The use of copper-nickel type filler rod for welding a copper plate to a steel plate or to a copper plate at a low temperature will not impair the properties of the copper plate. The curved corner portions of the heat receiving plate serve to eliminate or inhibit stress concentration because of the construction thereof. These features are very useful in eliminating leakage of cooling medium and the attendant explosion accident that are most likely to occur at the hot spots 7 and in the vicinity of the slag line 8.

What is claimed is:

1. A cooling box adapted to be installed in the refractory wall of a steel-making arc furnace for passing a cooling medium therethrough to cool the wall, the cooling box comprising:

a base plate having a lower inlet and an upper outlet for the cooling medium;

a heat receiving copper plate having integral therewith a slag lodging portion comprising alternating horizontal furrows and projections over the heat receiving surface thereof, each of said furrows having a depth which is approximately one half of the width of the furrow and curved corners, each of said projections having a width which is slightly larger than the width of said furrows; and a curved portion on each of its upper and lower ends and welded to the base plate to form a square or rectangular box;

a back plate disposed between the base and heat receiving plates closer to the heat receiving plate and welded to the box, the back plate and the heat receiving plate defining a cooling medium flow chamber in communication with the inlet and the outlet; and a plurality of horizontal partitions each connected to said back plate and to said heat receiving plate so as to define a vertical array of horizontal channels, the lower most of which being in direct fluid communication with said lower inlet and the uppermost of which being in direct fluid communication with said upper outlet, with successive pairs of each said horizontal flow channels being connected at a successively alternating side so as to result in a zig-zag flow pattern starting at said lower inlet, extending horizontally across the width of the heat receiving plate along a lowermost horizontal channel, returning horizontally back along a second horizontal channel directly above said lowermost horizontal channel, extending horizontally across said width along a third horizontal channel directly above said second channel and so on back and forth across successively higher channels until said upper outlet is reached, said horizontal partitions dividing the flow chambers further being arranged at a predetermined spacing larger than that of the furrows.

2. A cooling box as defined in claim 1, wherein the heat receiving plate is a deoxidized rolled copper plate and is welded to the base plate with a filter rod of the copper-nickel type by low temperature welding.

3. A cooling box as defined in claim 1 wherein the heat receiving plate has a larger thickness than the base plate and the back plate, and the curved portion of the heat receiving plate has a radius of curvature larger than the thickness of the heat receiving plate.

* * * * *